US006942414B2

(12) United States Patent
Wong et al.

(10) Patent No.: US 6,942,414 B2
(45) Date of Patent: Sep. 13, 2005

(54) EASY-TO-LOAD SHEET PROTECTORS

(75) Inventors: Galen C. Wong, Pasadena, CA (US); Matthew A. Grace, Hemet, CA (US); Martin Daffner, Long Beach, CA (US); Kocheng M. Wu, West Covina, CA (US); Donn W. Meade, Chicopee, MA (US)

(73) Assignee: Avery Dennison Corporation, Pasadena, CA (US)

( * ) Notice: Subject to any disclaimer, the term of this patent is extended or adjusted under 35 U.S.C. 154(b) by 41 days.

(21) Appl. No.: 10/779,594

(22) Filed: Feb. 12, 2004

(65) Prior Publication Data

US 2005/0180810 A1 Aug. 18, 2005

(51) Int. Cl.[7] ..... B42F 13/00

(52) U.S. Cl. ..... 402/79; 281/38; 402/80 R; D19/33

(58) Field of Search ..... 402/73, 79, 80 R, 402/80 P; 281/38, 45; D19/26, 27, 33

(56) References Cited

U.S. PATENT DOCUMENTS

| | | | | |
|---|---|---|---|---|
| 1,172,190 A | | 2/1916 | Baugh | |
| 1,175,691 A | | 3/1916 | Blizard | |
| 1,913,634 A | | 6/1933 | Impey | |
| 2,232,975 A | | 2/1941 | Schade | |
| 2,630,122 A | * | 3/1953 | Amberg | 40/537 |
| 3,043,737 A | * | 7/1962 | Engelstein | 156/196 |
| 3,669,252 A | | 6/1972 | Evans | |
| 3,735,516 A | | 5/1973 | Wenstrom | |
| 4,516,871 A | | 5/1985 | Leitman | |
| 4,784,508 A | | 11/1988 | Shannon | |
| 4,787,766 A | | 11/1988 | Lorsch | |
| 4,925,720 A | | 5/1990 | Hansen | |
| D312,277 S | | 11/1990 | Moor | |
| D325,928 S | | 5/1992 | Bourgeois | |
| 5,265,359 A | | 11/1993 | Glazer et al. | |

(Continued)

OTHER PUBLICATIONS

C-Line Products, Inc., "Rapid Load Sheet Protectors," webpage: http://www.c-lineproducts.com/news/added-features.html, 2001.

*Primary Examiner*—Monica S. Carter
(74) *Attorney, Agent, or Firm*—Eric K. Satermo

(57) ABSTRACT

A sheet protector includes a front panel and a back panel attached together to form a pocket and a margin. The pocket may have an opening extending along a top edge of the panels. The margin extends along a side of the pocket. The opening may extend a distance into the margin such that a width of the opening is greater than a width of the pocket. For example, the width of the opening may be at least about 2% greater than the width of the pocket. Alternatively, a sheet protector includes a sheet of material folded about a fold line to form the front panel and the back panel. The panels are welded together at a bottom weld line, an outer weld line located along one side, and at an inner weld line located in a spaced relationship from the outer weld line. A margin is defined between the outer and inner weld lines, and a pocket is defined between the panels and within the fold line, the bottom weld line, and the inner line, with an opening being defined along the top edges of the panels. The inner weld line may extend to a location that is short of the top edges of the panels, such that the opening of the pocket extends a distance into the margin.

20 Claims, 7 Drawing Sheets

U.S. PATENT DOCUMENTS

| | | | | |
|---|---|---|---|---|
| 5,335,027 | A | 8/1994 | Lin et al. | |
| 5,375,936 | A | 12/1994 | Jennison et al. | |
| 5,558,454 | A | 9/1996 | Owen | |
| 5,572,815 | A | 11/1996 | Kovner | |
| 5,651,628 | A | 7/1997 | Bankes et al. | |
| 5,727,894 | A | 3/1998 | Covey | |
| 5,788,283 | A | 8/1998 | Adler | |
| 5,795,089 | A | 8/1998 | Ong | |
| 5,829,857 | A | 11/1998 | Olugboji | |
| 5,876,145 | A | 3/1999 | Datum | |
| 5,909,979 | A | 6/1999 | Winzen | |
| 6,012,866 | A | 1/2000 | Podosek | |
| D421,050 | S | 2/2000 | Henrikson et al. | |
| 6,019,539 | A | 2/2000 | Lynton | |
| 6,086,281 | A | 7/2000 | Covey | |
| 6,168,340 | B1 | 1/2001 | Lehmann et al. | |
| 6,183,158 | B1 * | 2/2001 | Lynton | 402/79 |
| 6,189,841 | B1 | 2/2001 | LaPoint et al. | |
| 6,209,778 | B1 | 4/2001 | Henrikson et al. | |
| 6,241,286 | B1 | 6/2001 | Ogura et al. | |
| D447,170 | S | 8/2001 | Wolff et al. | |
| D458,633 | S | 6/2002 | Nada et al. | |
| 6,485,060 | B2 | 11/2002 | Nada et al. | |
| 6,547,472 | B2 | 4/2003 | Jordan | |
| 2002/0180204 | A1 | 12/2002 | Trump | |

* cited by examiner

EASY-TO-LOAD SHEET PROTECTORS

BACKGROUND OF THE INVENTION

The present invention relates sheet protectors for holding sheet material such a paper and the like. U.S. Pat. No. 6,012,866 assigned to Avery Dennison Corporation of Pasadena, Calif., described conventional fabrication techniques for sheet protectors, which patent in its entirety is incorporated herein by reference.

A conventional sheet protector 50 for holding a piece of sheet material 52 is shown in FIG. 1. The sheet protector 50 includes a front panel 54 and a back panel 56 that are configured to form a pocket 58 with an opening 60. The pocket 58 and the opening 60 have equal widths indicated by reference alpha $W_O$. The piece of paper 52 has a width $W_S$ that is slightly less than the width $W_O$ of the opening 60. For example, for a standard piece of paper having a width of 8½ inches, the width $W_O$ of the opening 60 is typically about 8 11/16 inches. Accordingly, the width $W_O$ of the opening 60 is only about 3/16 inch larger than the width $W_S$ of the paper 52, or only about 3/32 inch on either side of the paper 52 when received within the pocket 58. In other words, the width $W_O$ of the opening 60 is about 2.2% larger than the width $W_S$ of the paper 52.

To insert the paper 52 into the sheet protector 50, a person needs to align the leading edge of the paper 52 with the opening 60 and then to urge the paper 52 into the pocket 58. If the leading edge of the paper 52 is not aligned within the 3/16 tolerance, then the paper 52 will bind with one of the ends of the opening 60. Accordingly, care needs to be taken to ensure alignment of the paper 52 and the opening 60 in an otherwise relatively simple operation.

Accordingly, there is a need for a sheet protector that allows a relatively large degree of tolerance between the width of the opening of the pocket and the size of the sheet material being inserted into the pocket. The present invention satisfies this need.

BRIEF SUMMARY OF THE INVENTION

The present invention relates to sheet protectors. The invention also relates to sheet protectors which are designed to facilitate the insertion of sheet material.

According to one embodiment of the invention and by way of example only, a sheet protector may include a front panel and a back panel attached together to form a pocket and a margin. The pocket may have an opening extending along a top edge of the panels. The margin may extend along a side of the pocket that is substantially orthogonal to the opening. The opening may extend a distance into the margin such that a width of the opening is greater than a width of the pocket. For example, the width of the opening may be at least about 2% greater than the width of the pocket.

According to another embodiment, a sheet protector may include a sheet of material folded about a fold line to form the front panel and the back panel, with each panel having a top edge, a bottom edge, and side edges. The panels may be welded together at a bottom weld line located along the bottom edges of the panels, at an outer weld line located along or near the side edges that are opposite the fold line, and at an inner weld line located in a spaced relationship from the outer weld line. A margin may then be defined between the outer and inner weld lines, and a pocket may be defined between the panels and within the fold line, the bottom weld line, and the inner line, with the opening being defined along the top edges of the panels. The inner weld line may extend to a location that is short of the top edges of the panels, such that the opening of the pocket extends a distance into the margin.

One of the advantages of the sheet protectors of the invention is that the opening of the pocket is significantly greater than the width of the sheet material to be inserted into the pocket. Accordingly, the likelihood of the sheet material binding on the edges of the opening is significantly reduced. In addition, particular care need not be taken when inserting sheet material into the pocket because of the relatively great tolerance between the size of the opening and the size of the sheet material.

Other features and advantages of the present invention will become apparent to those skilled in the art from a consideration of the following detailed description taken in conjunction with the accompanying drawings.

DETAILED DESCRIPTION OF THE INVENTION

Figure 2:
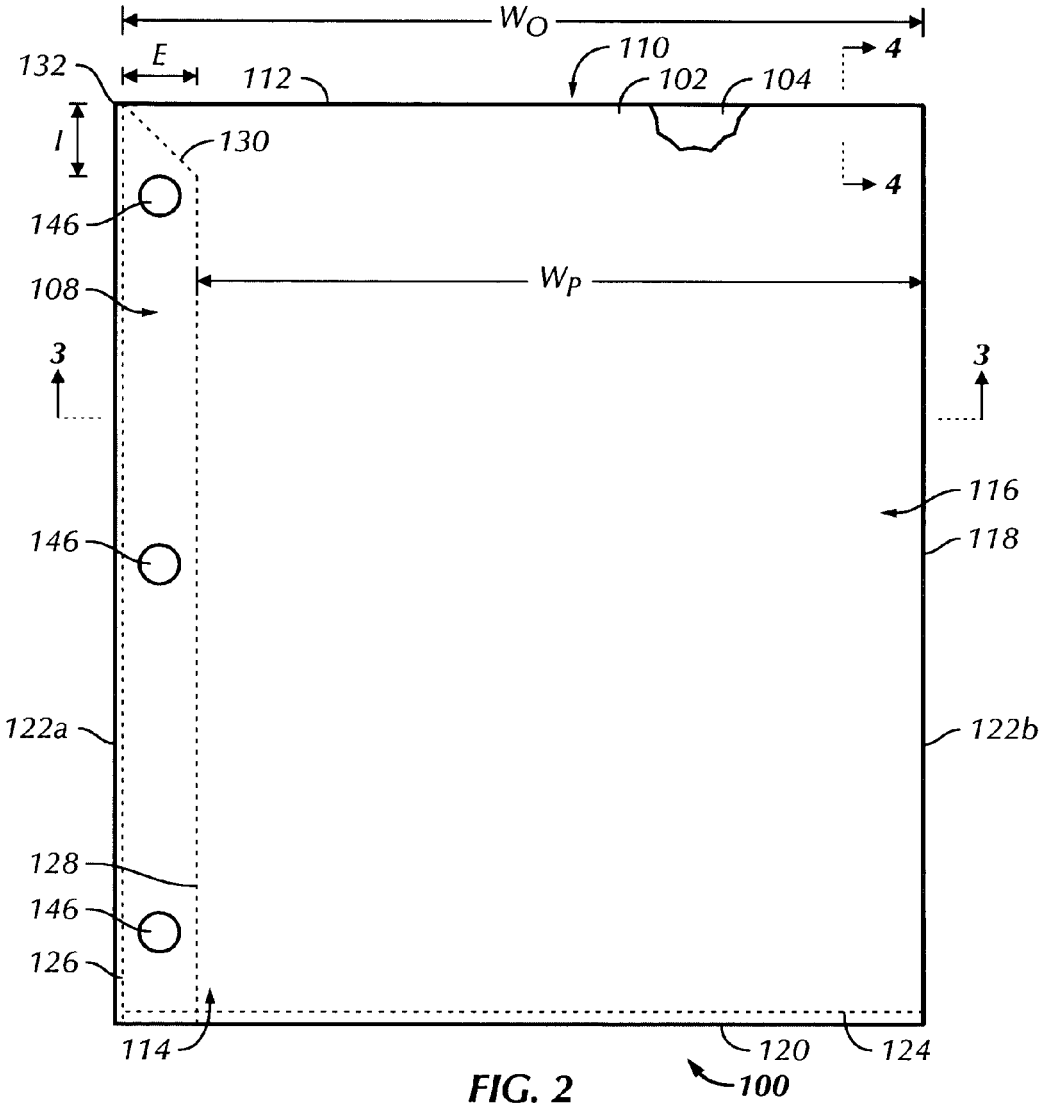
FIG. 2 is a plan view of a sheet protector, partially cut away, according to a number of embodiments.
Figure 3:
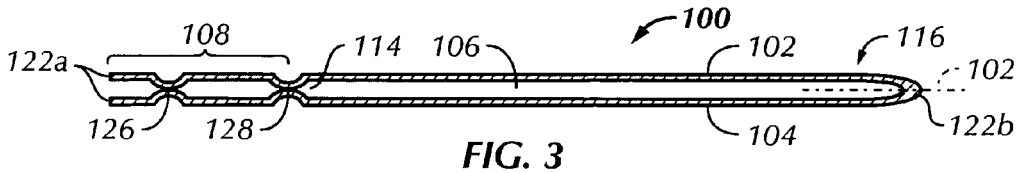
FIG. 3 is a cross-sectional view of the sheet protector of FIG. 1 taken along line 3—3.
Figure 4:
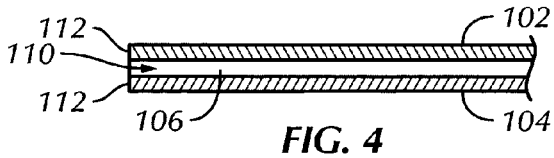
FIG. 4 is a cross-sectional view of the sheet protector of FIG. 1 taken along line 4—4.

Referring more particularly to FIGS. 2 and 3 of the drawings, a sheet protector 100 is designed so that a piece of sheet material may be easily inserted into the sheet protector. In contrast to conventional designs, the sheet protectors 100 have an increased tolerance in size between a pocket opening and a piece sheet material for which the sheet protector is configured.

In a number of embodiments, the sheet protector 100 may include a front panel 102 and a back panel 104 attached together to form a pocket 106 and a margin 108. The pocket 106 may have an opening 110 extending along one side or edge of the panels, e.g., a top edge 112. The margin 108 may extend along a side of the pocket 106, which side is indicated by reference numeral 114 in FIG. 3, such that the margin 108 may be described as being substantially orthogonal to the opening 110 or to the top edge 112 of the panels 102 and 104.

In some of the embodiments, the opening 110 may extend a distance into the margin 108 as indicated by reference alpha E, thereby resulting in a width $W_O$ of the opening 110 being greater than a width $W_P$ of the pocket 106. This relationship between the width $W_O$ of the opening 110 and the width $W_P$ of the pocket 106 is also shown in the embodiments of the sheet protectors 100 illustrated in FIGS. 5 and 6.

Figure 1:
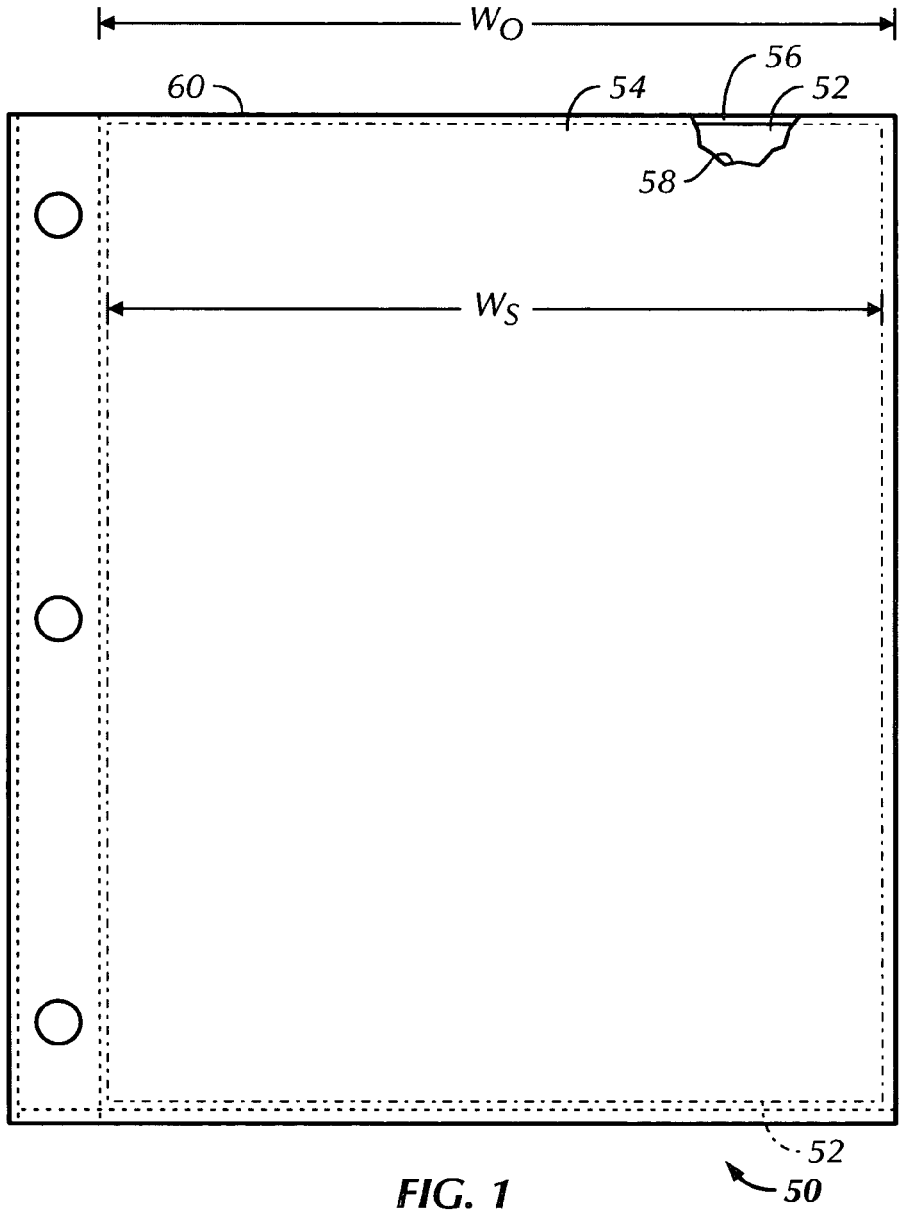
FIG. 1 (Prior Art)
FIG. 1 is a plan view of a sheet protector according to the prior art.

As an example of this relationship in the widths, embodiments in which the sheet protector 100 is configured for holding a standard sheet piece of paper measuring 8½ by 11 inches will be used (such as paper 52 of FIG. 1). Referencing FIG. 2, the width $W_P$ of the pocket 106 may be about 8 11/16 inches, and the width $W_O$ of the opening 110 may be about 9 3/16 inches, such that the distance E may be about ½ inch. Accordingly, in this example, the width $W_O$ of the opening 110 is over 8% larger than the width $W_S$ of the standard piece of paper and about 6% (specifically 5.76%) greater than the width $W_P$ of the pocket 106. In the embodiments shown in FIGS. 5 and 6 in which the opening 110 extends between side edges 122*a* and 122*b*, the distance E may be about ⅝ inch, such that the width $W_O$ of the opening 110 is over 9.5% larger than the width $W_S$ of a standard sheet of paper and about 7% (specifically 7.19%) greater than the width $W_P$ of the pocket 106. Generally speaking, in many embodiments the width $W_O$ of the opening 110 may be at least about 2% greater than the width $W_P$ of the pocket 106.

In other embodiments, the sheet protector 100 may be described as including a sheet 116 of material folded about a fold line 118 to form the front panel 102 and the back panel 104. Each of the panels 102 and 104 may be described as having the top edge 112, a bottom edge 120, and side edges 122*a* and 122*b*. As shown in FIG. 3, the fold line 118 may be described as defining edges 122*b* of the panels 102 and 104. In many embodiments, the sheet material 116 may be transparent so that an article received within the pocket 106 may be viewed.

In many embodiments, the panels 102 and 104 may be welded together at a bottom weld line 124 located along or near the bottom edges 120 of the panels, at an outer weld line 126 located along or near the side edges 122*a* that are opposite the fold line 118, and at an inner weld line 128 located in a spaced relationship from the outer weld line 126. The margin 108 may then be defined as being located either between the outer and inner weld lines 126 and 128 or between the inner weld line 128 and side edges 122*a*, the latter embodiment of which is illustrated in FIG. 3. In these embodiments, the pocket 106 may be defined between the panels 102 and 104 and within the fold line 118, the bottom weld line 120, and the inner line 128, with the opening being defined along the top edges 112 of the panels.

Figure 5:
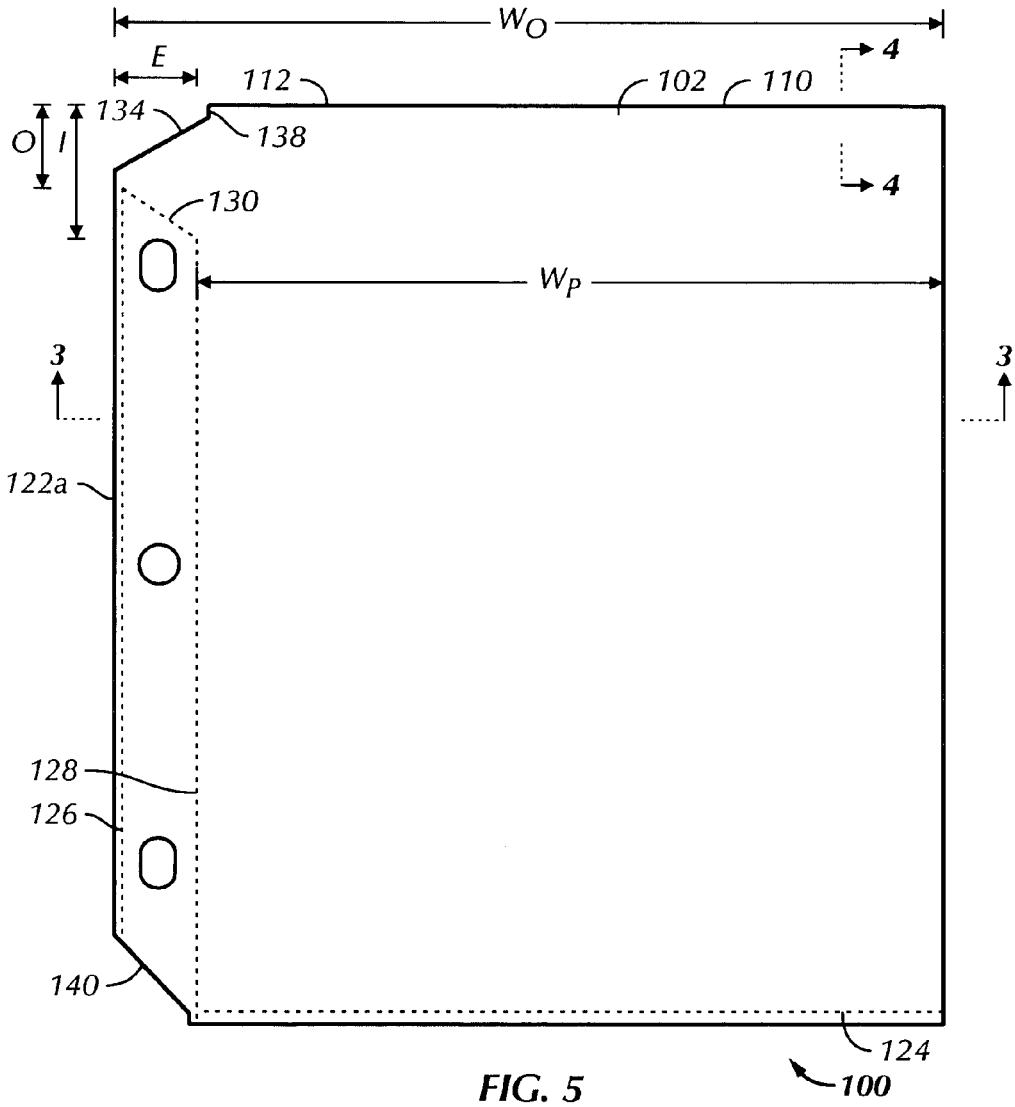
FIG. 5 is a plan view of a sheet protector according to a number of other embodiments.
Figure 6:
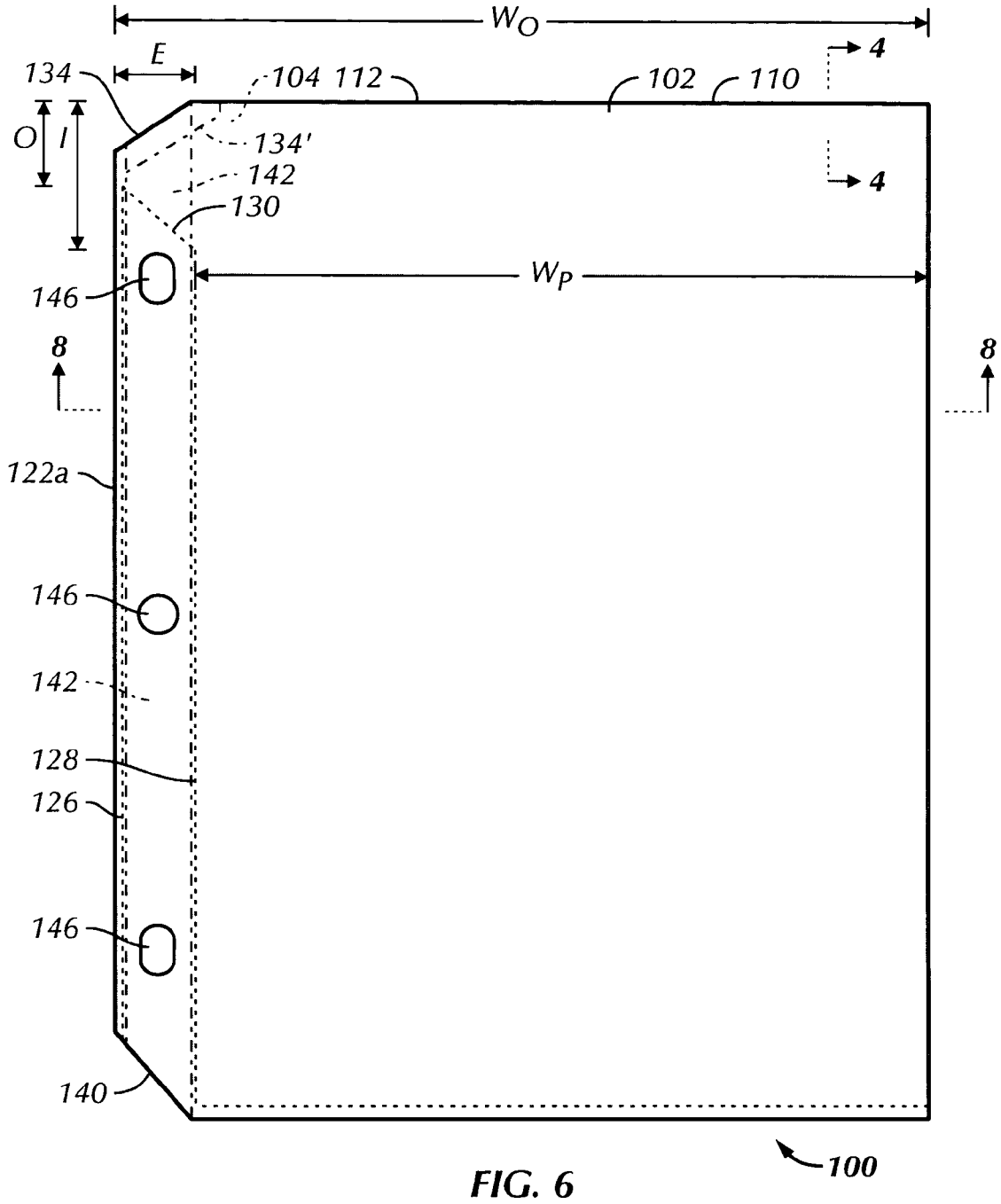
FIG. 6 is a plan view of a sheet protector according to still other embodiments.

In a number of embodiments, the inner weld line 128 may extend from, for example, the bottom weld line 124 to a location that is short of the top edges 112 of the panels 102 and 104, which is indicated by reference alpha I in FIGS. 2, 5, and 6, such that the opening 110 of the pocket 106 extends a predetermined distance into the margin 108. Although shown in the drawings, it is not necessary for the inner weld line 128 to intersect or cross the bottom weld line 124.

In the embodiment of the sheet protector 100 shown in FIG. 2, the outer weld line 126 extends to the top edges 112 of the panels 102 and 104. Alternatively, in the embodiments shown in FIGS. 5 and 6, the outer weld line 126 may extend to a location that is short of the top edges 112 of the panels 102 and 104, which is indicated by reference alpha O in FIGS. 5 and 6, such that the opening 110 of the pocket 106 extends completely through the margin 108, i.e., to side edges 122*a*.

In many of the embodiments, the panels 102 and 104 may be welded together along a margin weld line 130 that may extend from the inner weld line 128 to the outer weld line 126. The margin weld line 130 may be substantially perpendicular to the weld lines 126 and 138 or, alternatively, may be angled with respect thereto as shown in the drawings.

As shown in the embodiment illustrated in FIG. 2, the margin weld line 130 may intersect the outer weld line 126 at or near a top margin corner 132 of the panels 102 and 104 (or at the top edges 112 of the panels). Alternatively, as shown in the embodiments illustrated in FIGS. 5 and 6, the margin weld line 130 may intersect the outer weld line 126 at a location spaced from the top edges 112 of the panels 102 and 104, for example, at the location indicated by reference alpha O. In some of the embodiments, the location at which the margin weld line 130 intersects the outer weld line 126 may be at least about ¼ inch from the top edges 112 of the panels 102 and 104. Other embodiments regarding this location are described below.

Referencing FIGS. 5 and 6, in many of the embodiments, the panels 102 and 104 may have a notch 134 disposed at an upper area of the margin 108 (i.e., the top margin corner 132 as represented in the embodiment shown in FIG. 2 may be cut off). In the embodiment shown in FIGS. 6 and 7, the notch 134 of the front panel 102 may be smaller in size than the notch 134' of the back panel 104. As specifically shown in FIG. 7, the differently sized notches 134 and 134' may define a tab 136 on the front panel 102 (that is, the tab 136 may be defined as the portion of the front panel 102 that extends beyond the back panel 104 at the notch 134). The tab 136 may facilitate the initial feeding of a piece of sheet material into the pocket 106.

In addition, the notch 134 may be angled between the top edges 112 and side edges 122*a* (as shown by notch 134 of the front panel 102 in FIG. 6). Alternatively, as shown in FIG. 5, the notch 134 may include a discontinuity 138 at or near one or both of the edges 112 and 122*a* (and as shown by notch 134' of the back panel 104 in FIG. 7). In still other embodiments, the panels 102 and 104 may have a second notch 140 disposed at a lower area of the margin 108 as shown in FIGS. 5 and 6.

Figure 8:
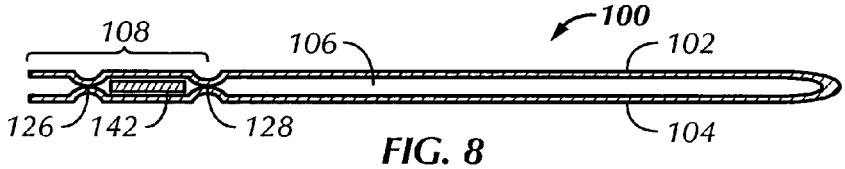
FIG. 8 is a cross-sectional view of the sheet protector of FIG. 6 taken along line 8—8.
Figure 7:
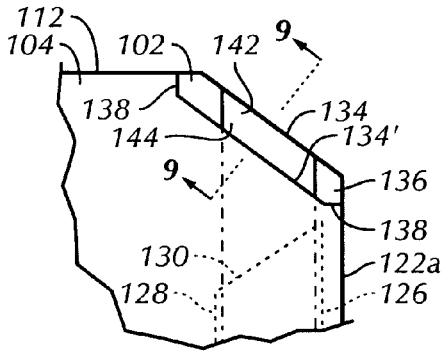
FIG. 7 is an enlarged fragmentary view of a notched corner of the sheet protector of FIG. 6.
Figure 9:
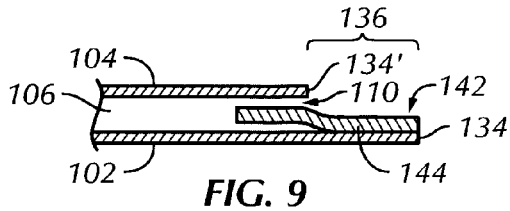
FIG. 9 is a cross-sectional view of the sheet protector of FIG. 6 taken along line 9—9 of FIG. 7.

With reference to FIGS. 6, 7, and 8, in some of the embodiments, the sheet protector 100 may include a reinforcing strip 142 disposed in the margin 108 between the panels 102 and 104. As shown in FIGS. 7 and 9, in embodiments including a notch, a top end 144 of the strip 142 may be angled complementarily to or congruent with the notch (e.g., notch 134 of the front panel 102), with the top end 144 of the strip 142 being attached or welded to one of the panels (e.g., the front panel 102). In binding embodiments, the sheet protector 102 may include one or more binder holes 146 formed through the margin 108 and, in relevant embodiments, through the reinforcing strip 142.

Figure 10:
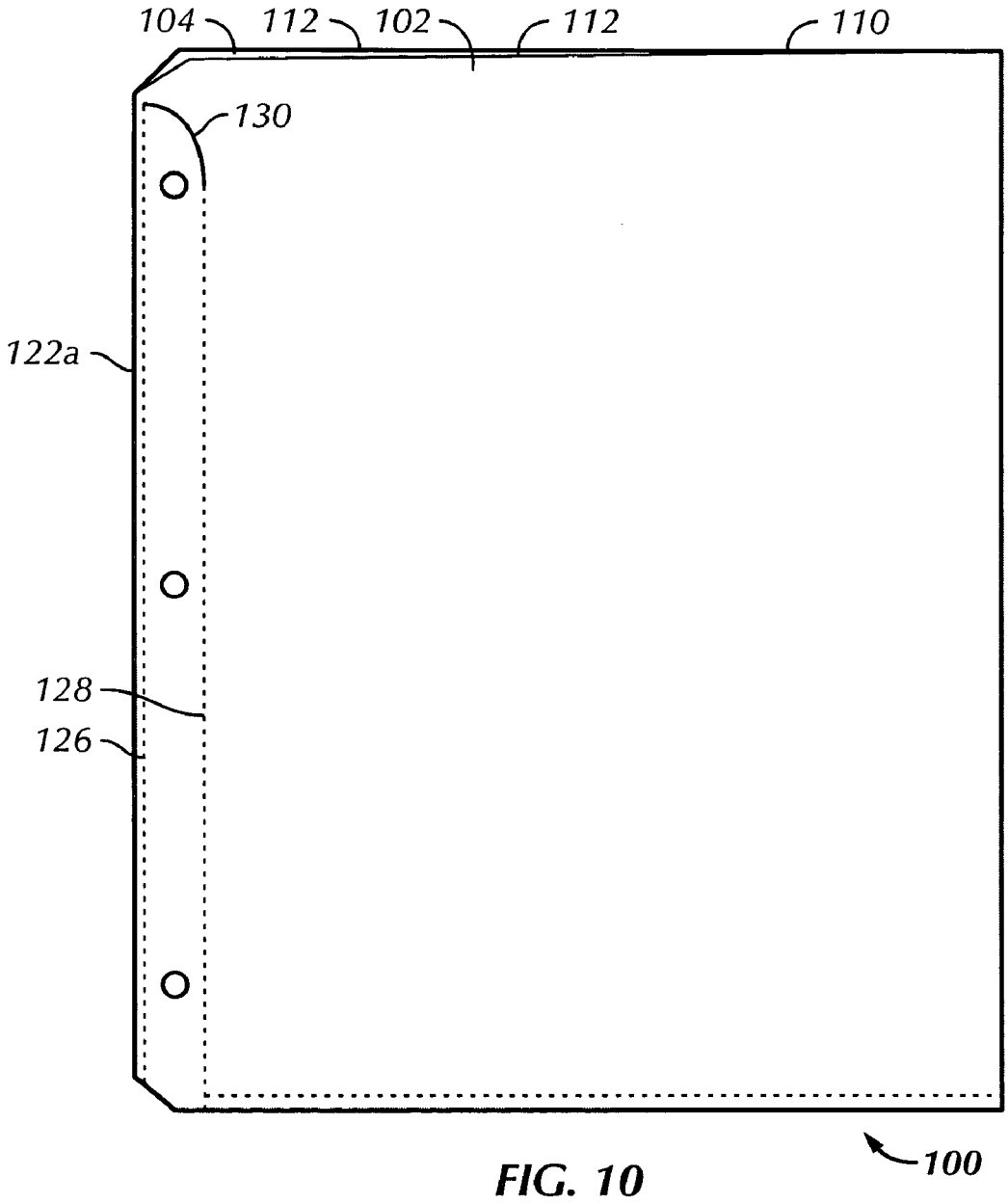
FIG. 10 is a plan view of a sheet protector according to further embodiments.
Figure 11:
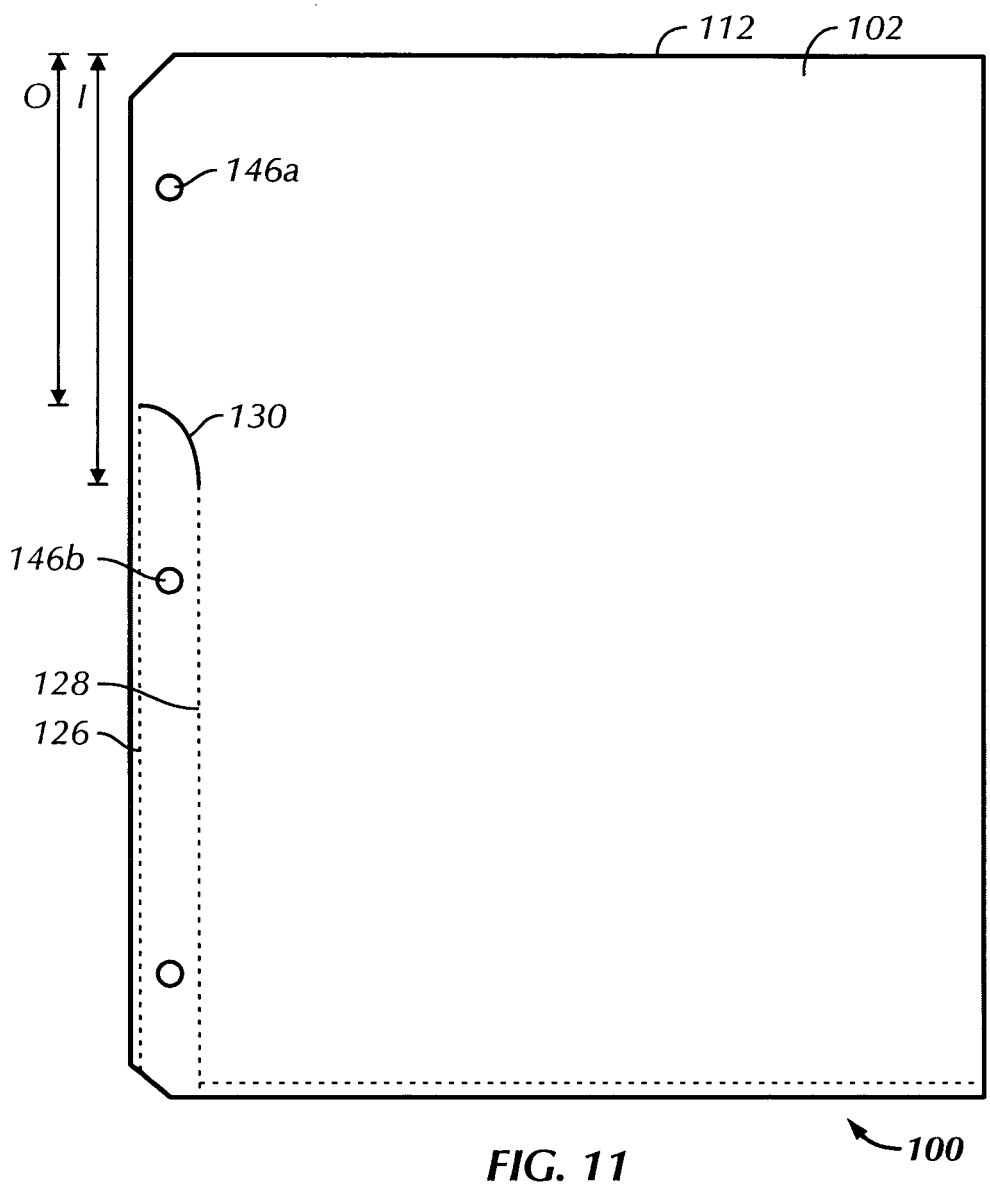
FIG. 11 is a plan view of a sheet protector according to yet still other embodiments.

Additional embodiments of the sheet protector 100 are shown in FIGS. 10, 11, and 12. In the embodiment illustrated in FIG. 10, the top edge 112 of the front panel 102 may be cut so that the top edge 112 of the front panel 102 angles away from the top edge 112 of the back panel 104. In addition, rather than being substantially linear, the margin weld line 130 may be curvilinear from the inner weld line 128 to side edges 122*a*.

In the embodiment shown in FIG. 11 and analogous to the embodiments described above, the inner weld 128 may extend to a location that is short of the top edges 112 of the panels 102 and 104, which is indicated by reference alpha I. In the three-ring binder embodiment shown, the inner weld line 128 may extend to a location that is between a top binder hole 146*a* and a center binder hole 146*b* (as opposed to the embodiments in, e.g., FIGS. 5 and 6 in which the inner weld line extends to a location at, near, or above the top binder hole). In addition, the outer weld line 126 may also extend to a location that is between binder holes 146*a* and 146*b* (as indicated by reference alpha O).

Those skilled in the art will understand that the preceding embodiments of the present invention provide the foundation for numerous alternatives and modifications thereto. For example, rather than folding the sheet material 116 about the fold line 118, the sheet protector 100 may include two separate panels 102 and 104 that are welded along the entire extend of side edges 122*b* between the top edges 112 and the bottom edges 120. These other modifications are also within the scope of the present invention. Accordingly, the present invention is not limited to that precisely as shown and described in the present invention.

What is claimed is:

1. A sheet protector comprising:

a sheet of material folded about a fold line to form a front panel and a back panel each having a top edge, a bottom edge, a pair of side edges, the fold line defining one of the pairs of side edges of the panels;

the panels being welded together at:

a bottom weld line located along the bottom edges;

an outer weld line located along the side edges opposite the fold line;

an inner weld line located in a spaced relationship from the outer weld line, such that a margin is defined between the outer and inner weld lines;

the fold line, the bottom weld line, and the inner line defining between the panels a pocket with an opening along the top edges of the panels;

the inner weld line extending to a location that is short of the top edges of the panels, such that the opening of the pocket extends into the margin.

2. A sheet protector comprising:

a sheet of material folded about a fold line to form a front panel and a back panel each having a top edge, a bottom edge, a pair of side edges, the fold line defining one of the pairs of side edges of the panels;

the panels being welded together at:

a bottom weld line located along the bottom edges:

an outer weld line located along the side edges opposite the fold line;

an inner weld line located in a spaced relationship from the outer weld line, such that a margin is defined between the outer and inner weld lines;

the fold line, the bottom weld line, and the inner line defining between the panels a pocket with an opening along the top edges of the panels;

the inner weld line extending to a location that is short of the top edges of the panels, such that the opening of the pocket extends into the margin;

wherein the outer weld line extends to a location that is short of the top edges of the panels, such that the opening of the pocket extends through the margin.

3. The sheet protector of claim 1 wherein the panels are welded together along a margin weld line extending from the inner weld line to the outer weld line.

4. The sheet protector of claim 3 wherein the margin weld line intersects the outer weld line at or near a top margin corner of the panels.

5. The sheet protector of claim 3 wherein the margin weld line intersects the outer weld line at a location spaced from the top edges of the panels.

6. The sheet protector of claim 3 wherein the margin weld line intersects the outer weld line at a location at least about ¼ inch from the top edges of the panels.

7. The sheet protector of claim 3 wherein the margin weld line extends at an angle outwardly from the inner weld line.

8. The sheet protector of claim 1 wherein the panels have a notch disposed at a top margin corner thereof.

9. The sheet protector of claim 8 wherein a size of the notch in the front panel is smaller than the size of the notch in the back panel.

10. A sheet protector comprising:

a sheet of material folded about a fold line to form a front panel and a back panel each having a top edge, a bottom edge, a pair of side edges, the fold line defining one of the pairs of side edges of the panels;

the panels being welded together at:

a bottom weld line located along the bottom edges;

an outer weld line located along the side edges opposite the fold line;

an inner weld line located in a spaced relationship from the outer weld line, such that a margin is defined between the outer and inner weld lines;

the fold line, the bottom weld line, and the inner line defining between the panels a pocket with an opening along the top edges of the panels;

the inner weld line extending to a location that is short of the top edges of the panels, such that the opening of the pocket extends into the margin;

wherein:

the panels have a notch disposed at a top margin corner thereof; and the panels include a tab formed at the notch.

11. The sheet protector of claim 1 further comprising a reinforcing strip disposed in the margin between the panels.

12. The sheet protector of claim 11 wherein the panels have a notch disposed at a top margin corner thereof, such that a top end of the strip is angled complementarily with the notch;

the top end of the strip being attached to one of the panels.

13. The sheet protector of claim 1 further comprising one or more binder holes formed through the margin.

14. The sheet protector of claim 1 wherein the opening has a width that is at least about 2% greater than a width of the pocket.

15. A sheet protector comprising:

a front panel and a back panel attached together to form:

a pocket having an opening extending along one side thereof; and a margin extending along another side of the pocket and substantially orthogonal to the opening;

the opening extending into the margin such that a width of the opening is greater than a width of the pocket.

16. The sheet protector of claim 15 wherein the panels being welded together at:

a bottom weld line located along bottom edges of the panels;

an outer weld line located along one set of side edges of the panels; and an inner weld line located in a spaced relationship from the outer weld line, such that the margin is defined between the outer and inner weld lines;

the inner weld line extending to a location that is short of the top edges of the panels.

17. The sheet protector of claim 15 wherein the inner weld line extends to a location that is at least about ¼ inch from the top edges of the panels.

18. A sheet protector comprising:

a pocket having a width;

a margin extending along one side of the pocket; and an opening having a width and extending along another side of the pocket and into the margin such that the width of the opening is greater than the width of the pocket.

19. A sheet protector comprising:

a pocket having a width;

a margin extending along one side of the pocket; and an opening having a width and extending along another side of the pocket and into the margin such that the width of the opening is greater than the width of the pocket;

wherein the opening extends completely through the margin.

20. The sheet protector of claim 18 wherein the width of the opening is at least about 2% greater than the width of the pocket.

* * * * *